US007850363B1

(12) United States Patent
Speidel et al.

(10) Patent No.: US 7,850,363 B1
(45) Date of Patent: Dec. 14, 2010

(54) ADJUSTABLE LIGHTING FIXTURE WITH TOOL HOLDER

(75) Inventors: John Speidel, Highland Falls, NY (US); Vincent Gennarelli, Washingtonville, NY (US); Frank Reidmiller, Highland Lakes, NJ (US); Peter Eagleton, Yorktown Height, NY (US); Jose Cadena, Mt. Kisco, NY (US); Scott Wisniewski, Highland Falls, NY (US)

(73) Assignee: Lighting Services Inc., Stony Point, NY (US)

( * ) Notice: Subject to any disclaimer, the term of this patent is extended or adjusted under 35 U.S.C. 154(b) by 0 days.

(21) Appl. No.: 12/610,860

(22) Filed: Nov. 2, 2009

(51) Int. Cl.
*F21V 33/00* (2006.01)

(52) U.S. Cl. ..... 362/648

(58) Field of Classification Search ..... 362/648, 362/119, 120

See application file for complete search history.

(56) References Cited

U.S. PATENT DOCUMENTS 5,128,847 A * 7/1992 Lin et al. ..... 362/648
5,652,587 A * 7/1997 Liu ..... 341/176
5,702,177 A * 12/1997 Lin ..... 362/648

* cited by examiner

*Primary Examiner*—Laura Tso
(74) *Attorney, Agent, or Firm*—St. Onge Steward Johnston & Reens LLC

(57) ABSTRACT

An adjustable track lighting fixture of a type having rotary locking lever for securing the fixture to a bus bar, where the locking lever is economically formed with an internal confinement facility of removably housing an Allen key to be retained with the fixture and used for locking the adjustments of the fixture when desired. A spring, also housed internally of the locking lever, resiliently but releasably retains the Allen key until purposefully withdrawn by a workman. The key is returned to its confinement after the workman has finished using it for the purposes intended. The key is retained in an inconspicuous manner but nevertheless visible to the workman and readily extracted for use when desired.

4 Claims, 3 Drawing Sheets

ADJUSTABLE LIGHTING FIXTURE WITH TOOL HOLDER

FIELD OF THE INVENTION

The invention relates to specialized forms of adjustably positioned lighting fixtures, as frequently used in commercial and theatrical lighting, and particularly to features thereof to accommodate and facilitate periodic adjustment.

BACKGROUND OF THE INVENTION

Specialized lighting fixtures, such as theatrical lighting, and various forms of commercial lighting fixtures are constructed to provide for accurate aiming of a light beam. In many cases, after a lighting fixture is initially installed, it may be adjusted one or more times until a desired effect is achieved. At that juncture, it may be desired to tightly lock the adjustments, so that vibrations and other external influences will not, over time, result in undesired movements in the adjusted position of the fixture. For effectively tight locking of the adjustments, a tool frequently is required. However, if the workman does not have the correct tool at the proper time, the final locking of the adjustments may not be carried out.

SUMMARY OF THE INVENTION

The invention is directed to an improvement in adjustable lighting fixtures of the type described, particularly for track lighting systems, which include novel and effective facilities for housing a locking tool in the fixture itself in a reliable and secure manner, easily accessible to a workman. Typically a suitable locking tool is an Allen key, of a size to be engageable with one or more Allen screws provided on the fixture, for securely tightening the fixture in an adjusted position when appropriate and desired. The Allen key is mounted in a convenient manner and location, easily accessible to the workman, yet is securely retained against accidental dislodgment and loss, and is easily replaced by the workman when finished with the locking operations.

An advantageous form of track lighting fixture of existing design includes a mounting body arranged to be received within a downwardly opening recess of a bus bar containing conductive elements for operating lighting fixtures positioned anywhere along the bar. The mounting body includes a rotatable element carrying electrical contacts and a clamping element, all operated by a rotatable locking lever accessible at the bottom of the mounting body. After the mounting body is positioned in the bus bar, the locking lever is rotated such that the electrical and the clamping elements are rotated into engagement with the bus bar, securing the fixture in position and engaging its electrical contacts with the conductors of the bus bar. The new fixture incorporates a novel and specialized design of locking lever, which enables it to conveniently house an Allen key in a secure manner which is at the same time easily accessible to a workman for locking an adjusted lighting fixture in a desired orientation and also conveniently restored to its position within the locking lever so as to be available for a future occasion. The proper tool thus always accompanies the fixture and is always available to a workman installing, re-installing and/or adjusting the fixture.

For a more complete understanding of the invention reference should be made to the following detailed description of a preferred embodiment thereof and to the accompanying drawings.

DETAILED DESCRIPTION OF THE INVENTION

Figure 1:
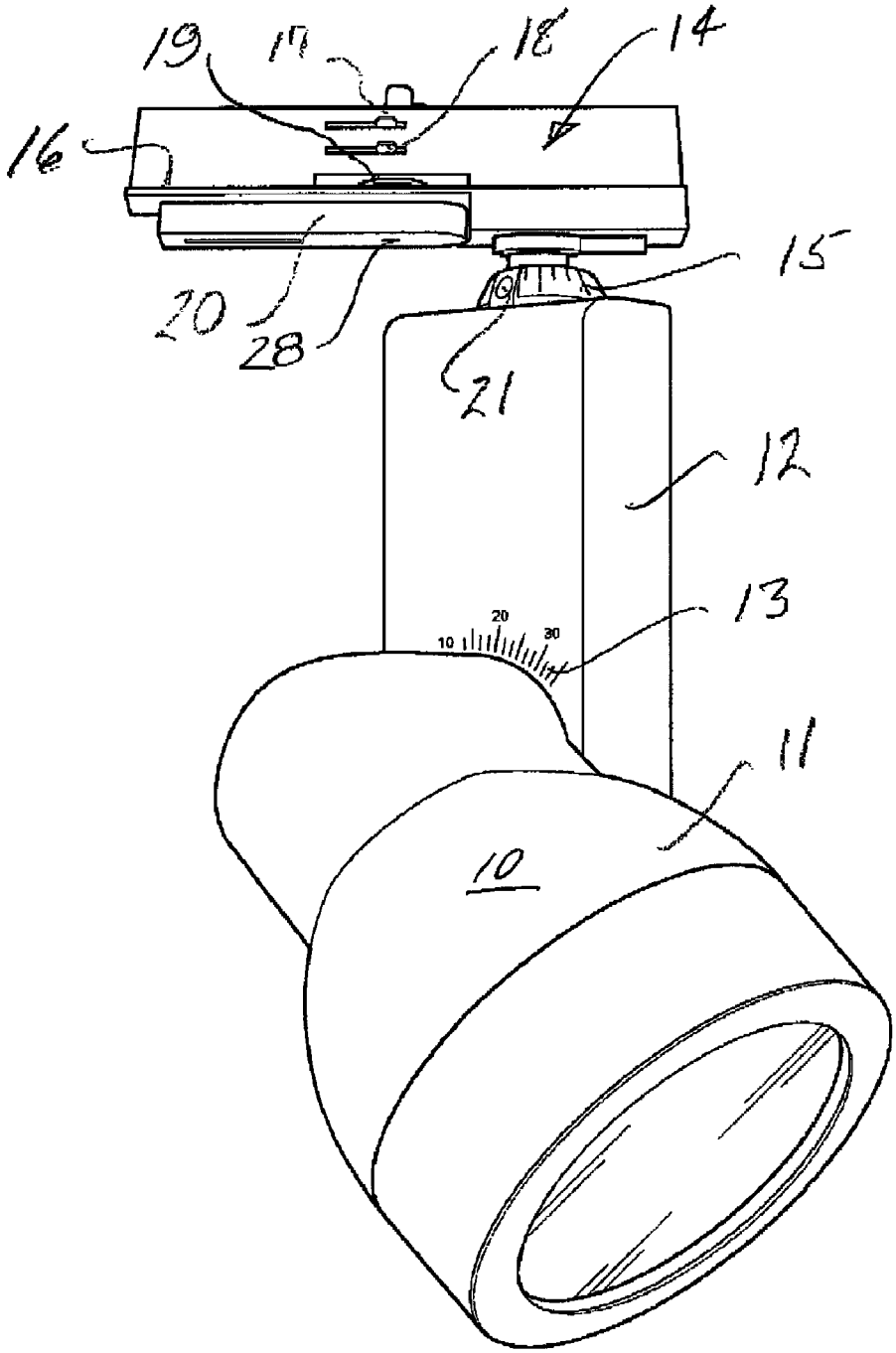
FIG. 1 is a perspective view of an advantageous form of track lighting fixture incorporating the features of the invention.

Referring now to the drawings, the reference numeral 10 designates generally a track lighting fixture which, except for features to be described hereinafter, is of a known type with known features which do not form part of this invention. The illustrated fixture includes a lamp body 11 which is mounted on a transformer housing 12 for rotation with respect to the housing 12 about a horizontal axis. Suitable calibration indices 13 may be provided to assist in properly orienting the housing 11 with respect to its rotational axis. The transformer housing 12 is attached to a mounting body 14 and is arranged for rotation with respect to the mounting body 14, about a vertical axis. Calibration indices 15 also can be provided to facilitate proper rotational adjustment about the vertical axis.

The mounting body 14 is of an inverted T-shaped cross sectional configuration, suitable to be received within the downwardly opening recess of a typical bus bar (not shown). A flange 16 at the bottom of the mounting body seats against bottom surfaces of the bus bar.

For mounting the fixture 10 in the bus bar, the mounting body 14 houses an internal rotary element (not shown) carrying electrical contacts 17, 18 and a clamping element 19. The rotary element is fixed to a rotary locking lever 20 located underneath the flange 16. For the initial mounting of the fixture, the lever 20 is rotated at right angles to the mounting body 14, to retract the contacts 17, 18 and the clamping element 19 into the mounting body. After the mounting body is positioned in the bus bar, the lever 20 is rotated to a position parallel with the mounting body, as shown in FIG. 1, simultaneously to cause the clamping element 19 to lockingly engage the bus bar and to cause the contacts 17, 18 to engage linear conductors within the bus bar.

After mounting the fixture on the bus bar, the lamp housing 11 is normally adjusted about its respective horizontal and vertical axes to cause light from the fixture to be properly focused on a desired subject area. Typically, there is sufficient friction in the horizontal and vertical rotational connections to enable the housing 11 to remain in an adjusted position. However, over time, various influences such as vibrations, temperature variations, accidental bumping etc., can cause an initial adjusted position to change. Accordingly, manufacturers frequently provide locking devices, such as Allen screws, for tightly locking the elements in their adjusted positions to largely prevent such undesired movements. One such Allen screw is indicated at 21 in FIG. 1 for the vertical axis adjustment, and a similar such screw (not visible) is provided on the housing 11 for locking the horizontal axis adjustment.

Figure 2:
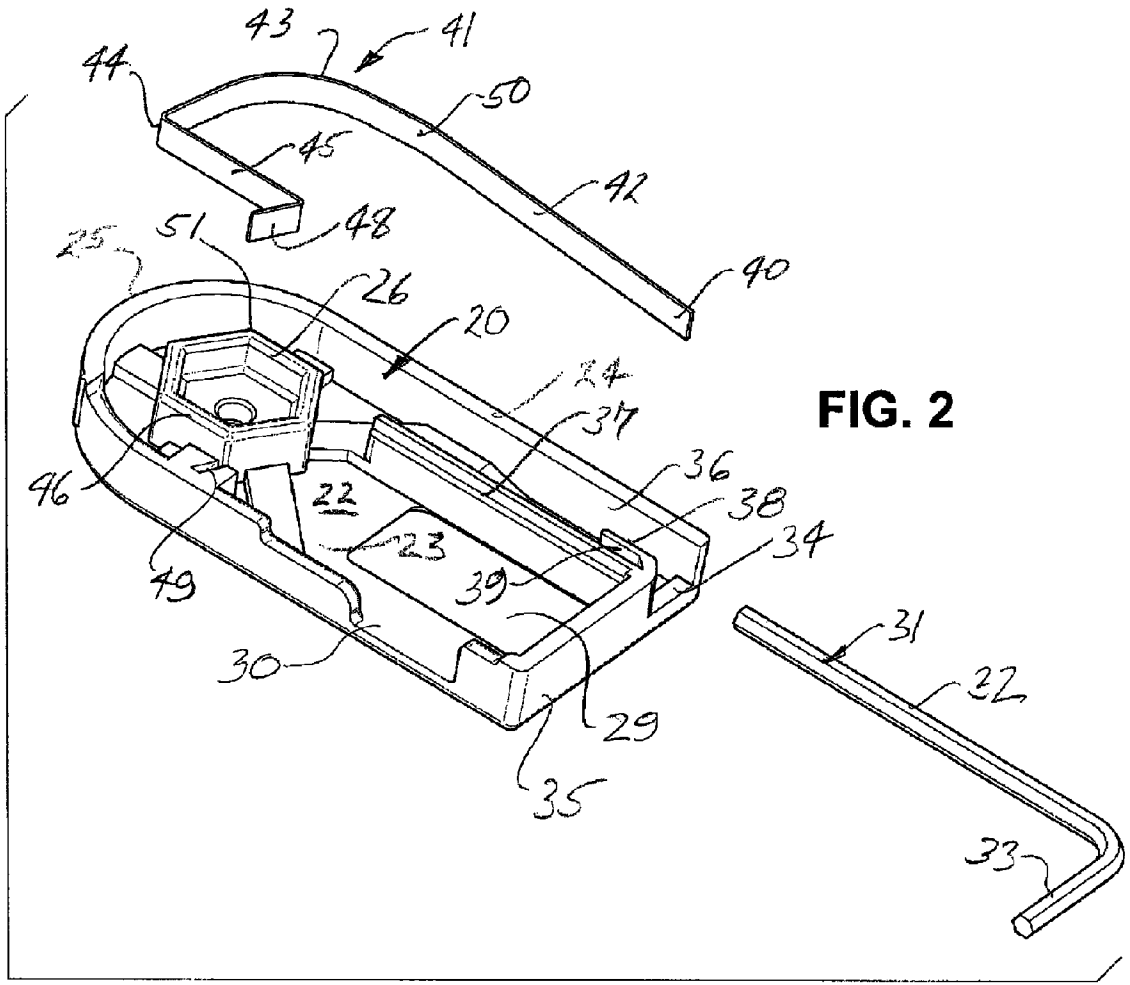
FIG. 2 is an exploded view of a rotatable locking lever, utilized in the fixture of FIG. 1, incorporating features of the invention.
Figure 3:
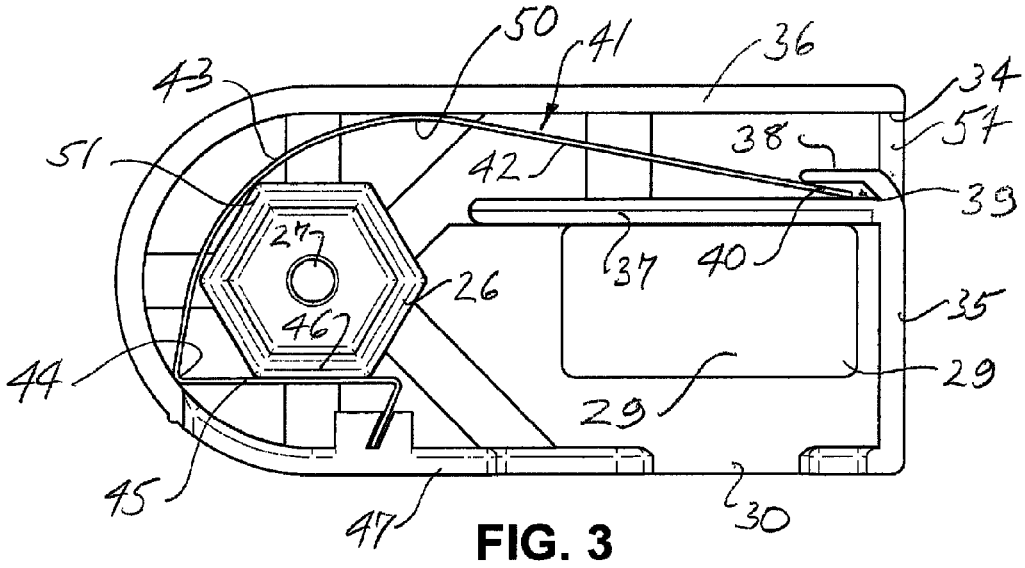
FIGS. 3 and 4 are top plan views of the locking lever of FIG. 2, showing features according to the invention for receiving and securely retaining an Allen key for use in setting the lighting fixture in a semi-permanent manner after its initial adjustments have been completed.
Figure 4:
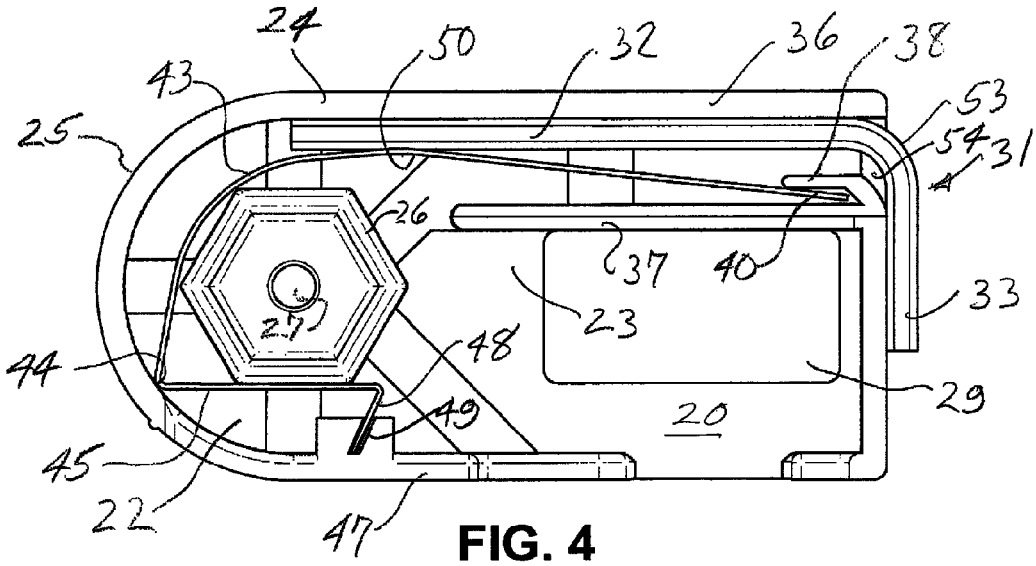

Pursuant to the invention, a locking lever 20 of novel design is provided to enable each lighting fixture to be provided with an Allen key suitable for its components, with the Allen key being inserted and retained in the locking lever so as to be available at all times for securing of the fixture in its adjusted position. With reference to FIGS. 2-4, the locking lever 20 comprises a molded plastic body 22 formed with a generally flat bottom wall 23, a surrounding wall 24 and a rounded end 25 to accommodate rotation. At the center of the rounded end, the lever is formed with socket walls 26 forming a hexagonal socket engageable with a correspondingly shaped element (not shown) forming the bottom of the previously mentioned rotary element in the mounting body 14. A screw fastener 28 is engageable through opening 27 at the center of the socket defined by walls 26, for fixing the lever 20 to the rotary element.

Locking levers 20 generally are well known devices for use in the mounting of track lighting fixtures and frequently are formed with a bottom opening 29 providing access to an on-off switch (not shown). An associated side recess 30 allows the lever to be rotated to engage or disengage the fixture when the switch is in its "off" position. The locking lever of the invention, however, includes an additional and unique feature for receiving and reliably retaining an Allen key 31. As shown in FIGS. 2 and 4, a standard Allen key 31 is of L-shaped configuration comprised of a long leg 32 and a short leg 33. The locking lever of the invention is formed with an opening 34 in an end portion 35 of the surrounding wall, with one side of the opening being defined by a side wall portion 36. The side wall portion 36 forms a guide for receiving the long leg of the Allen key 31 and forms one side of a cavity for retaining the key. In this respect, the length of the locking lever 22 is such that the entire long leg of the Allen key can be received within the lever 22, with the short leg positioned tightly against the end wall portion 35 (see FIG. 4).

Spaced inward from the guide wall 36 is an inner confinement wall 37, which is spaced from the guide wall and defines therewith a confinement space considerably greater than the thickness of the Allen key. In the illustrated and preferred embodiment of the invention, the confinement wall 37 is formed, adjacent to the end wall opening 34 with a short re-entrant wall 38 defining an inwardly facing, open ended recess 39. The recess 39 is arranged to receive one end 40 of a generally J-shaped strip spring 41. The spring 41 includes an elongated stem portion 42, which is received in the confinement space between walls 36, 37, and an arcuate portion 43 configured to pass part way around the socket wall 36. The arcuate portion 43 joins at an apex 44 with a straight portion 45 passing in contact with a facet 46 of the socket wall 26 that lies parallel with the opposite side portions 36, 47 of the wall 24. The straight portion 45 of the spring terminates in an outwardly and rearwardly directed end element 48, which is received in a recess slot 49 on the inside of the wall portion 47.

The spring 41 is assembled with the molded lever body by inserting the spring downwardly into the open top of the lever body, inserting the opposite ends of the spring into their respective confining slots 39, 49. The geometry of the spring 41 is such that, when initially assembled, a portion 50 of the spring, between the straight and arcuate portions 42, 43 lies close to, and preferably bears resiliently against the inner surface of the side wall 36, as shown in FIG. 3. To advantage the arcuate portion 43 of the spring may be pressed outward by corner 51 of the socket wall 46 to help press the spring portion 50 against the wall 36.

As shown in FIGS. 3 and 4, the straight portion 42 of the strip spring 41 extends diagonally across the confinement space between the walls 36, 37 at a small angle thereto. Accordingly, when the long leg 32 of the Allen key is inserted into the end opening 34, the end of the key is confined between the spring and the wall 36. As the key is forced inward, it displaces the spring inwardly in the region of the portion 50. When the Allen key is fully inserted, as shown in FIG. 4, the long leg 32 of the key is tightly gripped between the spring portion 50 and the wall 36 and is removable only by an intentional withdrawal by a service man or other person.

As shown in FIG. 4, the Allen key 31 is formed with a generous rounding in the area 53 between the short and long legs 33, 32. To accommodate this rounding, the end wall opening 34 is substantially wider than the maximum thickness of the key stock. This allows the key to be inserted into the lever 22 sufficiently that the short leg 33 of the key comes into contact with the end wall 35. It also stabilizes the key by providing a support surface 54 to position and hold the short leg 33 parallel with the bottom surface 23 of the locking lever. Only the short leg of the key is visible externally, and that is positioned tightly against the end wall of the lever 22 so as to be inconspicuous while being readily available for use.

The key-holding feature of the invention can be incorporated with track lighting fixtures of existing design with minimal cost, consisting of the cost of the spring 41 and its assembly, and minor, one-time mold revisions to accommodate the presence of the spring and to define a recess and an opening for the Allen key.

The new feature has substantial commercial significance in that it makes the overall product substantially more attractive to potential customers. Maintaining the adjustable lighting fixtures in accurate adjustment is a concern of all users thereof, and the improvement of the present invention greatly simplifies such maintenance and, more importantly, makes it more likely that the necessary or desired locking of the fixture adjustment will in fact take place. When "final" adjustments of a fixture have been completed, it is largely assured that the fixture adjustment can and will be properly locked because the required tool is always available to the service person.

It should be understood, of course, that the specific form of the invention herein illustrated and described is intended to be representative only as various changes may be made therein without departing from the clear teachings of the disclosure. Accordingly, reference should be made to the following claims in determining the full scope of the invention.

What is claimed is:

1. In combination with a track lighting fixture of a type having a mounting body for reception in a bus bar, a rotatable element in said mounting body having electrical and mechanical elements engageable with said bus bar, a locking lever secured to said rotatable element for limited rotational movement with respect to said mounting body for securing said mounting body to said bus bar, a lamp housing carried by said mounting body and adapted for adjustable positioning with respect thereto on at least one axis, and at least one locking screw for locking said lamp housing in an adjusted position, the improvement in said locking lever characterized by (a) said locking lever comprising a member molded of plastic material and having a bottom wall and a surrounding wall structure extending upward from said bottom wall, (b) said wall structure including an end wall and said end wall having a tool receiving opening therein close to an adjacent side wall portion of said wall structure, (c) a retention spring received within said surrounding wall structure and having a first portion positioned adjacent said tool receiving opening on the side thereof spaced from said adjacent side wall portion, (d) said retention spring having a elongated portion extending away from said opening and extending diagonally at a small angle toward said adjacent side wall and into close convergence therewith, (e) said tool receiving opening being of a size to receive a long leg of an L-shaped Allen key having a long leg and a short leg, and (f) said retention spring being constructed to cause the elongated portion of said retention spring to bear resiliently against the long leg of an Allen key inserted into said opening, and (g) said elongated spring portion being operative to resiliently confine and removably retain said long leg against said adjacent side wall.

2. The combination of claim 1, wherein (a) said locking lever includes a socket-forming wall extending upward from the bottom wall for engagement with said rotatable member, (b) said retention spring has a generally J-shaped configuration including an arcuate portion extending from said elongated portion and partially around said socket-forming wall, and an end portion extending from said arcuate portion and anchored on said locking lever, and (c) the arcuate portion of said spring engages said socket-forming wall, at least when an Allen key is received in said opening, to increase spring pressure applied against said Allen key.

3. The combination of claim 2, wherein (a) said L-shaped Allen key has a rounded portion between said legs, and (a) said tool receiving opening is of substantially greater width than the thickness of said key, whereby a portion of said rounded portion is received in said opening and supported by said locking lever to resist rotation.

4. In combination with a track lighting fixture of a type having a mounting body for reception in a bus bar, a rotatable element in said mounting body having electrical and mechanical elements engageable with said bus bar, a locking lever secured to said rotatable element for limited rotational movement with respect to said mounting body for securing said mounting body to said bus bar, a lamp housing carried by said mounting body and adapted for adjustable positioning with respect thereto on at least one axis, and at least one locking screw for locking said lamp housing in an adjusted position, the improvement in said locking lever characterized by (a) said locking lever comprising a member molded of plastic material and having a bottom wall and a surrounding wall structure extending upward from said bottom wall, (b) a tool receiving opening in said surrounding wall and a tool confinement space within said lever communicating with said tool receiving opening, (c) said opening and said confinement space being of a size and shape to receive a long leg of an L-shaped Allen key having a long leg and a short leg, and (d) a retention spring positioned in said locking lever to bear against the leg of an Allen key received in said confinement space to removably retain said key affixed to said lever with the short leg of said key substantially parallel to said bottom wall.

* * * * *